US007465195B1

(12) United States Patent
Kerrigan et al.

(10) Patent No.: US 7,465,195 B1
(45) Date of Patent: Dec. 16, 2008

(54) CIRCUIT BOARD CONNECTOR

(75) Inventors: Brian Michael Kerrigan, Cary, NC (US); Timothy Andreas Meserth, Durham, NC (US); Tony Carl Sass, Fuquay Varina, NC (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 12/030,936

(22) Filed: Feb. 14, 2008

(51) Int. Cl.
*H01R 13/648* (2006.01)

(52) U.S. Cl. ..... 439/608

(58) Field of Classification Search ..... 439/65, 439/66, 608–610, 157–160
See application file for complete search history.

(56) References Cited

U.S. PATENT DOCUMENTS 4,684,182 A * 8/1987 Gussman ..... 439/159
5,290,192 A * 3/1994 Espenshade et al. ..... 439/70
6,368,137 B1 * 4/2002 Orwoll ..... 439/342
6,540,522 B2 4/2003 Sipe
6,659,808 B2 12/2003 Billman et al.
6,663,427 B1 12/2003 Billman et al.
6,739,918 B2 5/2004 Cohen et al.
6,749,468 B2 6/2004 Avery
6,764,349 B2 7/2004 Provencher et al.
6,773,305 B2 * 8/2004 Wu ..... 439/608
6,808,419 B1 * 10/2004 Korsunsky et al. ..... 439/607
6,814,620 B1 11/2004 Wu
6,884,117 B2 * 4/2005 Korsunsky et al. ..... 439/607
6,923,655 B2 * 8/2005 Korsunsky et al. ..... 439/65
6,986,682 B1 1/2006 Jeon
7,108,567 B1 9/2006 Korsunsky et al.
7,134,913 B1 11/2006 Hasircoglu et al.
7,281,950 B2 * 10/2007 Belopolsky ..... 439/608
7,390,194 B1 * 6/2008 Crippen et al. ..... 439/65

* cited by examiner

*Primary Examiner*—Briggitte R Hammond
(74) *Attorney, Agent, or Firm*—Cynthia Byrd; Jeffrey L. Streets

(57) ABSTRACT

A mezzanine connector is used to connect two circuit boards. A connector frame includes a first frame member secured to the first circuit board and a second frame member secured to the second circuit board. The first and second frame members are brought together and mechanically connected to one another. A wafer carrier movably disposed between the first and second frame members holds a plurality of wafers at a substantially fixed spacing and parallel alignment. Each wafer has a plurality of electrically conductive pathways. After mechanically coupling the two frame members, the wafer carrier is movable toward the second circuit board from an open circuit position to a closed circuit position to provide electronic communication between the first and second circuit boards.

20 Claims, 6 Drawing Sheets

CIRCUIT BOARD CONNECTOR

BACKGROUND OF THE INVENTION

1. Field of the Invention

The present invention relates to electronic connectors. More particularly, the present invention relates to connectors for structurally and electrically connecting circuit boards.

2. Description of the Related Art

A variety of circuit boards and circuit board connectors are used in computer systems. The main circuit board ("main board") of a PC or server is commonly referred to as a motherboard, which has a plurality of electronic components connected by electrical communication pathways. Motherboard components include processors, drive controllers, video controllers, primary memory, interrupt controllers, and BIOS, as well as electronic connectors for interfacing with additional components. Electronic connectors are typically included with a motherboard for connecting additional circuit boards, such as a "daughter card," to provide electronic communication (i.e. the transfer of power and signal information) between the motherboard and the circuit boards to be connected. The terms "daughter card" and "daughter board" may refer to an extension or "daughter" of a motherboard or other main board. A daughter board may include plugs, sockets, pins, or connectors for attaching still other boards to the daughter card.

As electronic packaging becomes increasingly dense, the number and density of high-speed electronic connectors increases. Consequently, the mechanical integrity of circuit boards and supporting infrastructure is limited, such as in the case of thin blade servers. Such circuit boards and infrastructure may be prone to failure due to the relatively high mating forces between components, such as between two circuit boards. Conventional electronic connectors typically include two connector members each having an array of mating terminals or pins that are frictionally joined with one another as a result of mechanically coupling the two connector members. Thus, the forces required to mechanically connect the two connector members includes the force required to frictionally join a large number of mating terminals. Connecting the two connector members of a conventional connector, therefore, typically requires pressing one connector member into engagement with the other connector member. This step applies forces to the circuit boards being connected, as well as to any supporting structure for the two circuit boards. These forces and relative movement between the connector members and circuit boards being connected can damage the circuit boards or supporting structures. Furthermore, the individual pins on one connector are prone to damage if misaligned with the mating pins on the opposing connector prior to joining the circuit boards.

Therefore, improved connectors for electronic circuit boards are needed. One aspect to be improved may be to minimize the force required to connect two circuit boards, to minimize the resulting stresses placed on the two circuit boards and supporting structures. Increasing the reliability and durability of connectors would also be desirable.

SUMMARY OF THE INVENTION

The invention includes connectors and methods for connecting circuit boards. One embodiment provides a connector for connecting a first circuit board with a second circuit board. The connector has a connector frame including a first frame member secured to the first circuit board and a second frame member secured to the second circuit board. The first and second frame members are removably securable to one another. A wafer carrier movably disposed between the first and second frame members carries a plurality of wafers at a substantially fixed spacing. Each wafer has a plurality of electrically conductive pathways on a substantially non-conductive substrate. An actuator is provided for moving the wafer carrier toward the second circuit board from an open circuit position, in which the electrically conductive pathways are electrically connected with the first circuit board and electrically separated from the second circuit board, to a closed circuit position, in which the electrically conductive pathways are electrically connected with both the first and second circuit boards.

Another embodiment provides a method of connecting a first circuit board with a second circuit board. The method includes mechanically coupling a first frame member with a second frame member about a wafer carrier such that the wafer carrier is movably disposed between the first and second frame members. The wafer carrier carries a plurality of wafers at a substantially fixed spacing, and each wafer has a plurality of electrically conductive pathways on a substantially non-conductive substrate. The first frame member is secured to the first circuit board and the second frame member is secured to the second circuit board. The method further includes moving the wafer carrier toward the second circuit board from an open circuit position to a closed circuit position. In the open circuit position, the electrically conductive pathways are electrically connected with the first circuit board but electrically separated from the second circuit board. In the closed circuit position, the electrically conductive pathways are electrically connected with both the first and second circuit boards. Thus, moving the wafer carrier to the closed circuit position provides electronic communication between the first and second circuit boards.

Other embodiments, aspects, and advantages of the invention will be apparent from the following description and the appended claims.

DETAILED DESCRIPTION OF PREFERRED EMBODIMENTS

The invention includes connectors and methods for connecting circuit boards. The two circuit boards may be connected using very little force, and with minimal stresses to the circuit boards and surrounding components. One embodiment provides a mezzanine connector for connecting first and second circuit boards such that the plane of the first circuit board is parallel to the plane of the second circuit board. The mezzanine connector has a first frame member secured to a first circuit board and a second frame member secured to a second circuit board. The two frame members may be brought into contact with one another using very little (or essentially zero) force, and are then mechanically connected. A wafer carrier movably disposed between the two frame members holds a plurality of wafers in a substantially fixed spacing and parallel alignment. Each wafer has a plurality of electrically conductive pathways. While the first and second frame members are mechanically connected, the wafer carrier is movable from an open circuit position to a closed circuit position to complete electronic pathways from one circuit board to the other circuit board. Mechanically coupling the frame members prior to moving the wafer carrier localizes any stresses to internal connector components, and thereby minimizes any stresses to the circuit boards and components mounted on the circuit boards. Connecting the circuit boards in this fashion also helps prevent damage to mating electrical contacts by ensuring proper alignment between mating components.

Figure 1A:
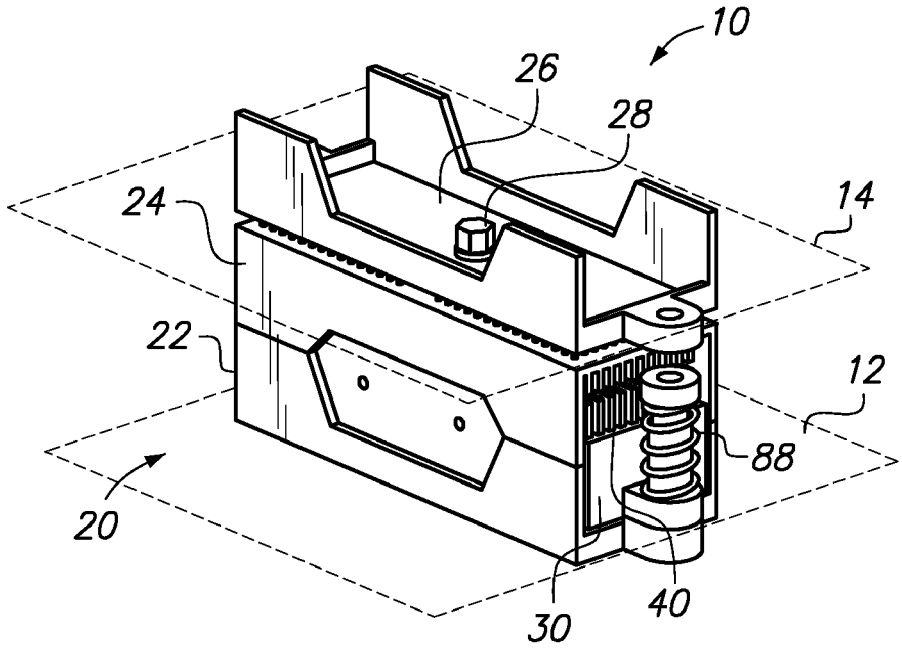
FIG. 1A is a perspective view of a connector for removably connecting two circuit boards.

FIG. 1A is a perspective view of one embodiment of a connector 10 for removably connecting a first circuit board 12 with a second circuit board 14. The first circuit board 12 may be, for example, a motherboard, and the second circuit board 14 may be, for example, a daughter card that expands the functionality of the motherboard. In this embodiment, the connector 10 may be referred to as a "mezzanine" type connector because it connects the circuit boards 12, 14 so that the plane of the first circuit board 12 is parallel to the plane of the second circuit board 14. However, the invention is not limited to mezzanine connectors. A frame 20 includes a first frame member 22 (shown here as the "lower" frame member) removably secured to a second frame member 24 (shown here as the "upper" frame member). The first and second frame members 22, 24 may include additional mating male/female design features, such as recesses on one that receive pins on the other (not shown), to help align and secure the two frame members 22, 24 with respect to one another. The first circuit board 12 is secured to a ball grid array of the first frame member 22, and the second circuit board 14 is secured to a ball grid array of the second frame member 24. When the frame members are mechanically connected, the frame 20 provides a fixed spacing and substantially parallel arrangement between the first and second circuit boards 12, 14. This closely-spaced, parallel arrangement of the first and second circuit boards 12, 14 gives the connector a compact form factor, which is particularly desirable in applications such as blade servers to minimize blade size and maximize blade density.

The connectivity provided by the connector 10 includes both a structural connection that mechanically connects the first and second circuit boards 12, 14, and an electrical connection that electronically connects the first and second circuit boards 12, 14 so that the circuit boards 12, 14 may electronically communicate with one another. A wafer carrier 30 is movably disposed between the frame members 22, 24. The wafer carrier 30 holds a plurality of wafers 40 at a fixed spacing and substantially parallel alignment with one another. As will be further explained below, the wafers 40 have electrically conductive pathways, and the wafer carrier 30 may be moved between an open circuit position and a closed circuit position to electrically connect or disconnect the circuit boards 12, 14.

A connector cap 26 is secured to one face of the circuit board 14 and the second frame member 24 is secured to the opposing face of the circuit board 14. The circuit boards 12, 14 are mechanically connected using a threaded fastener 28 that passes through the connector cap 26, the second circuit board 14, the second frame member 24, and threads to the wafer carrier 30. Additional coupling means, such as additional fasteners (not shown), may be used to bolster the mechanical connection of the frame members 22, 24. Examples of such coupling means include, without limitation, additional threaded member (e.g. screw and nut combinations) and solder lugs. The threaded fastener 28 is also used to selectively raise and lower the wafer carrier 30 by further rotating the threaded fastener 28. The circuit boards 12, 14 are placed in electronic communication by rotating the threaded fastener, to raise the wafer carrier 30 from the "open circuit position" shown in FIG. 1 to a "closed circuit position" that electrically bridges contacts on the circuit board 12 with contacts on the circuit board 14.

Figure 1B:
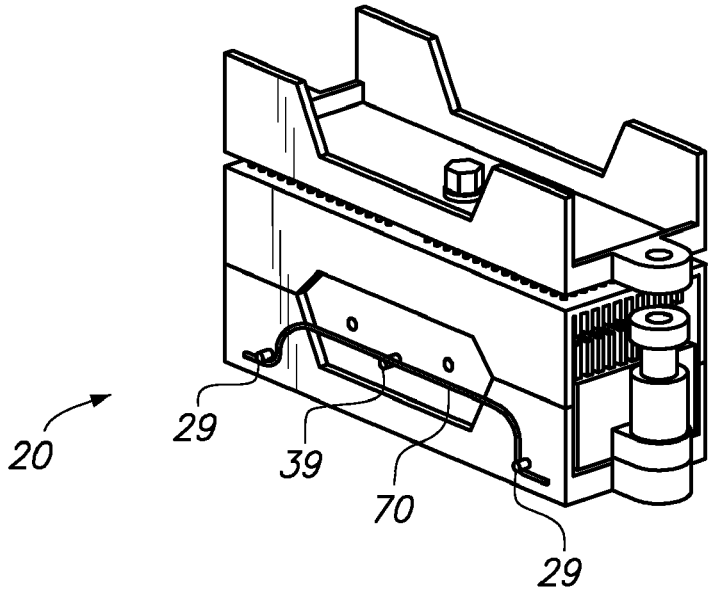
FIG. 1B is a perspective view of another embodiment of the connector having an alternate spring mechanism.

A spring 88 biases the wafer carrier 30 to the open circuit position. Parameters of the spring 88 such as the effective spring constant k may be selected to provide the desired biasing force. In the embodiment of FIG. 1A, the spring 88 is a coil spring, and when the wafer carrier 30 is moved from the open circuit position to the closed circuit position, the coil spring 88 is compressed. However, other types of springs known in the art may be substituted. For example, FIG. 1B is a perspective view of another embodiment of the connector 10 having an alternate spring mechanism for biasing the wafer carrier to the open circuit position. The coil spring 88 is omitted, and a spring 70 comprising a flexible rod or wire biases the wafer carrier 30 to the open position. The spring 70 is optionally secured, as shown, at or near its ends to tabs 29 on the first frame member 22, and at or near its center by a tab 39 on the wafer carrier 30.

Figure 2:
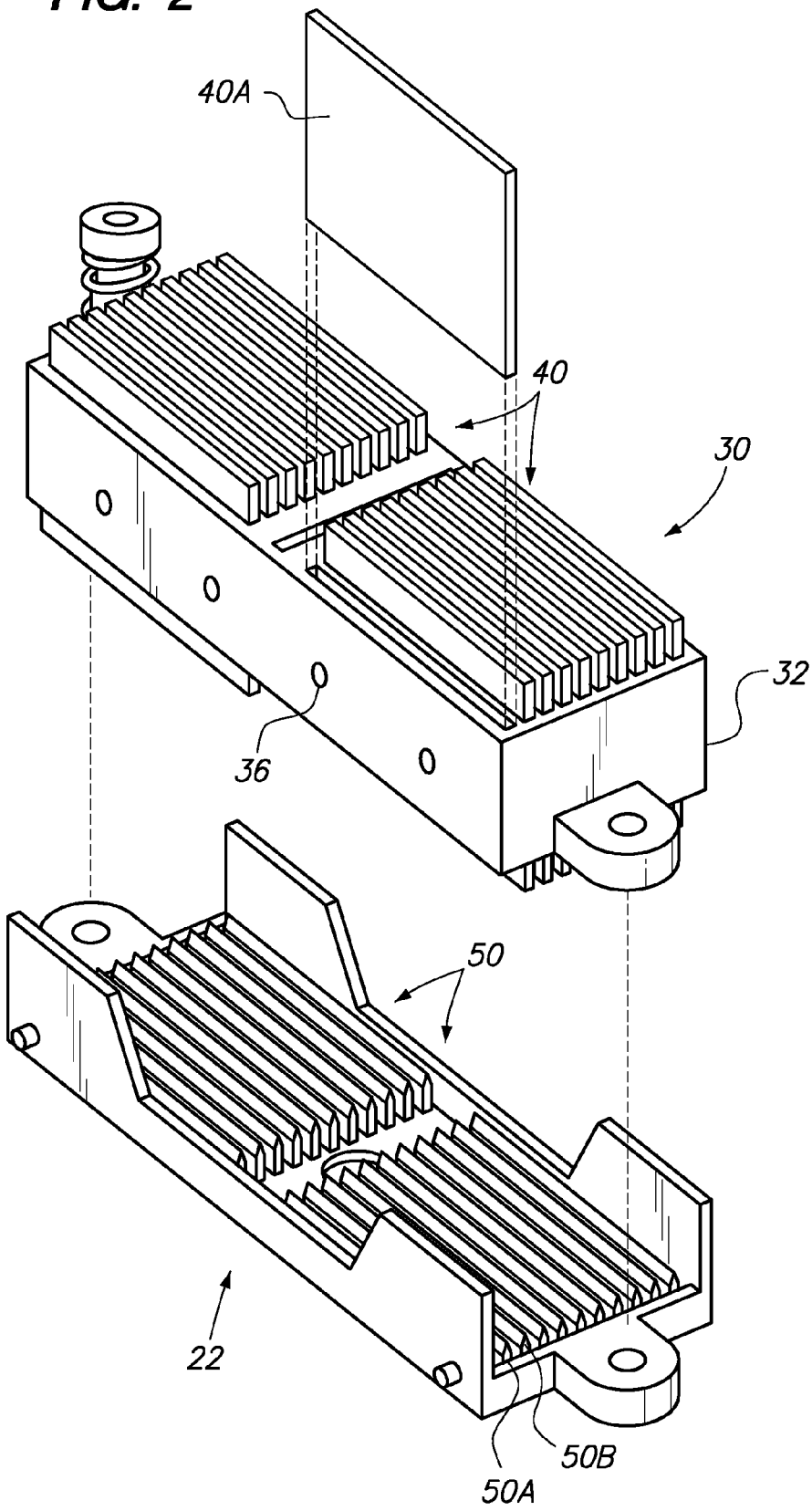
FIG. 2 is an exploded perspective view, from above, of the wafer carrier juxtaposed with the first frame member.

FIG. 2 is an exploded perspective view, from above, of a subset of connector components that includes the wafer carrier 30 juxtaposed with the first frame member 22, to show how the wafer carrier 30 fits on the first frame member 24. For clarity, other connector components are removed from view in FIG. 2. The wafer carrier 30 includes a carrier body 32 that holds a plurality of wafers 40 at a substantially fixed spacing and parallel alignment with respect to each other. This embodiment includes, by way of example, two columns of wafers 40 having ten wafers 40 per columns. The first frame member 22 has two columns of eleven orthogonally projecting fins 50, which are also at a substantially fixed spacing and parallel alignment with respect to each other. The fins 50 are spaced to slidably receive the wafers between adjacent fins 50. For example, the lower end of wafer 40A is received between adjacent fins 50A and 50B. The close positioning of the wafers 40 between the fins 50 in response to tightening the may lend structural support to the wafers 40 and to the connection between the circuit boards, as well as securing the rotational alignment of the wafer carrier 30 with respect to the first frame member 22.

Figure 2A:
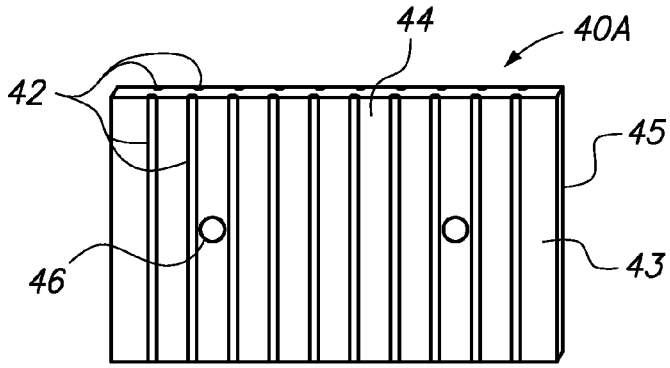
FIG. 2A is a side view of one of the wafers.
Figure 2B:
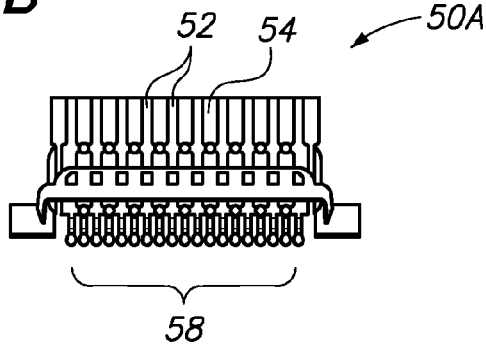
FIG. 2B is a side view of one of the fins.
Figure 2C:
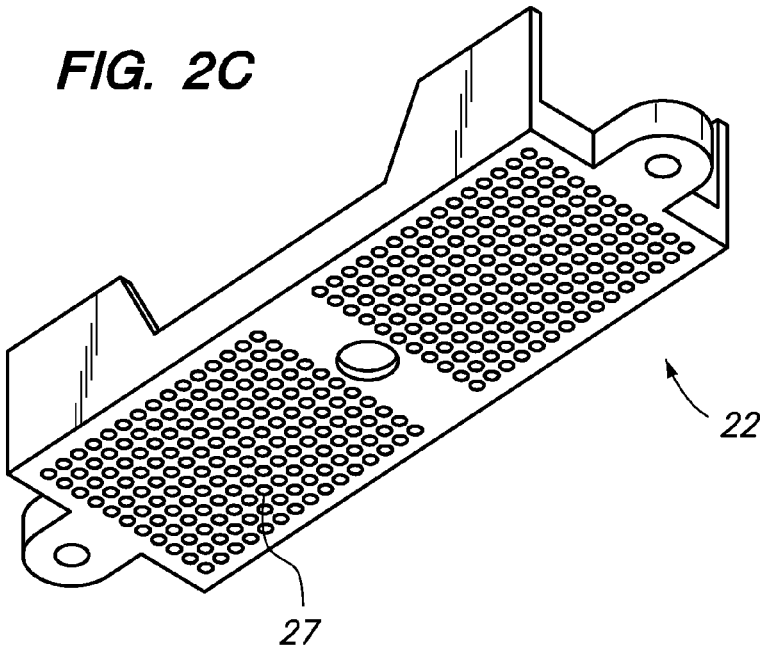
FIG. 2C is a perspective view from below of the first frame member.

FIGS. 2A, 2B, and 2C aid in the discussion of FIG. 2 by further detailing various components shown in FIG. 2. In particular, FIG. 2A is a side view of the wafer 40A, FIG. 2B is a side view of the fin 50A, and FIG. 2C is a perspective view from below of the first frame member 22. Referring to FIG. 2A, the wafers 40 each have a plurality of electrically conducting pathways 42 on a substantially non-conductive substrate 44. Any number of electrically conductive pathways 42 may conceivably be provided on each wafer 40. In this embodiment, the wafer 40A includes, by way of example, ten electrically conductive pathways 42 on the face 43 of the wafer, and another ten electrically conducting pathways 42 on the opposing face 45. A variety of fabrication techniques may be used for manufacturing the wafers 40. For example, the electrically conductive pathways 42 on the wafer 40A may be "traces" formed by etching copper sheets laminated onto the non-conductive substrate 44. The wafer 40A also includes holes 46 which may be used to secure the wafer 40A to the carrier body 32 (see FIG. 2), such as passing rods (not shown) through holes 36 in the carrier body 32 and through the holes 46 in the wafers 40.

As shown in FIG. 2B, the fin 50A includes a plurality of exposed, elongate electrical contacts 52 disposed on the surface of a non-conducting substrate 54. The elongate electrical contacts 52 terminate at conductive ball ends 58 that, along with the ball ends 58 on the other wafers 52 collectively form a "ball grid array" (BGA). As will further described below, the BGA mates with corresponding circuit board contacts that match the grid pattern of the BGA, so that the elongate electrical contacts 52 are electrically connected with the first circuit board 12. The BGA provides a high-density array for making many (e.g. several hundred) electrical connections between the two circuit boards 12, 14. When the fins 50A are assembled on the first frame member 22, as shown in FIG. 2, the ball ends 58 pass through an array of through-holes 27 on the first frame member 22 (see FIG. 2C), making electrical contact with the contacts (not shown) on the first circuit board 12 (see FIG. 1). When the wafers 40 are assembled onto the first frame member 22, the electrically conducting pathways on the wafers 40 are in sliding electrical contact with the corresponding elongate electrical contacts 52 on the fins 50. For example, the electrical pathways 42 on the face 43 of the wafer 40A will be in sliding electrical contact with the elongate electrical contacts 52 on one side of the fin 50A, and the electrical pathways 42 on the opposing face 45 of the wafer 40A will be in sliding electrical contact with the elongate electrical contacts 52 on one side of the adjacent fin 50B. As the wafer carrier 40 is moved up and down, the electrical pathways 42 therefore remain in contact with their respective elongate electrical contacts 52. As will be further explained below, the wafer carrier 40 may be moved up to connect the electrical pathways 42 with electrical contacts (similar to electrical contacts 52) on a similar fin secured to the second frame member 24 on the second circuit board 14, thereby providing electronic communication pathways between the first and second circuit boards 12, 14.

Figure 3:
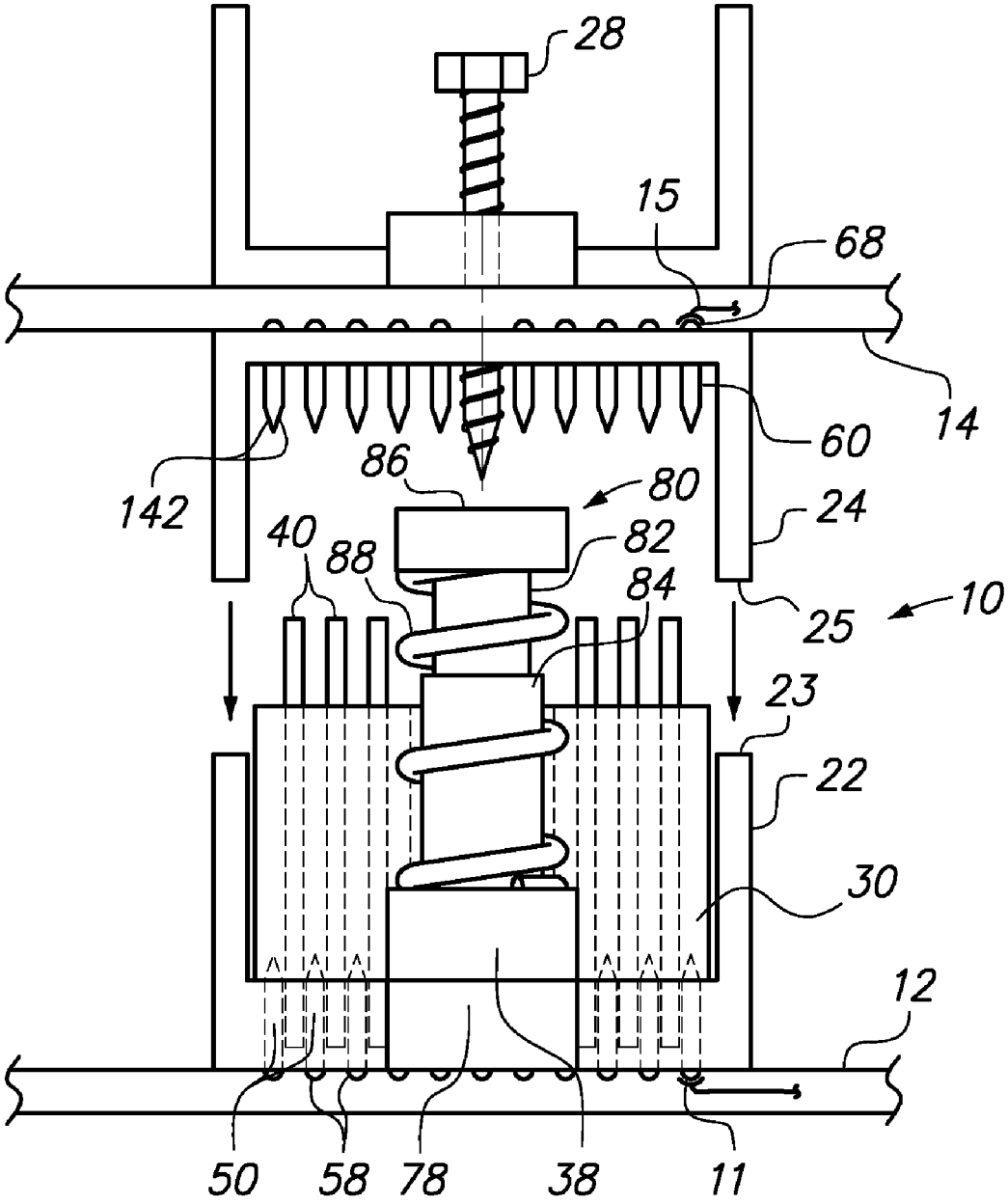
FIG. 3 is a side view of the first and second circuit boards being brought together for connecting with the connector of FIG. 1.
Figure 4:
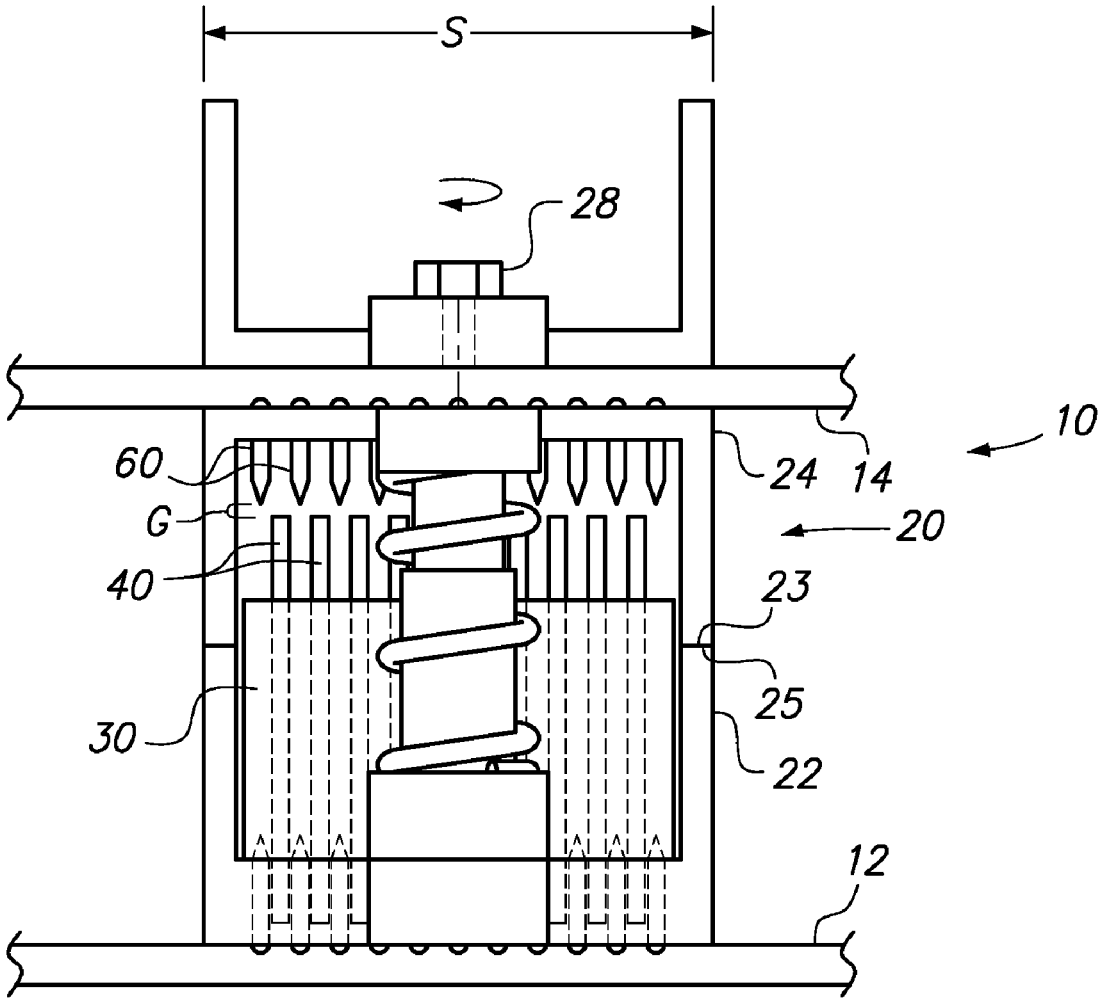
FIG. 4 is a side view of the first and second circuit boards having been brought together and structurally connected, prior to being electrically connected.
Figure 5:
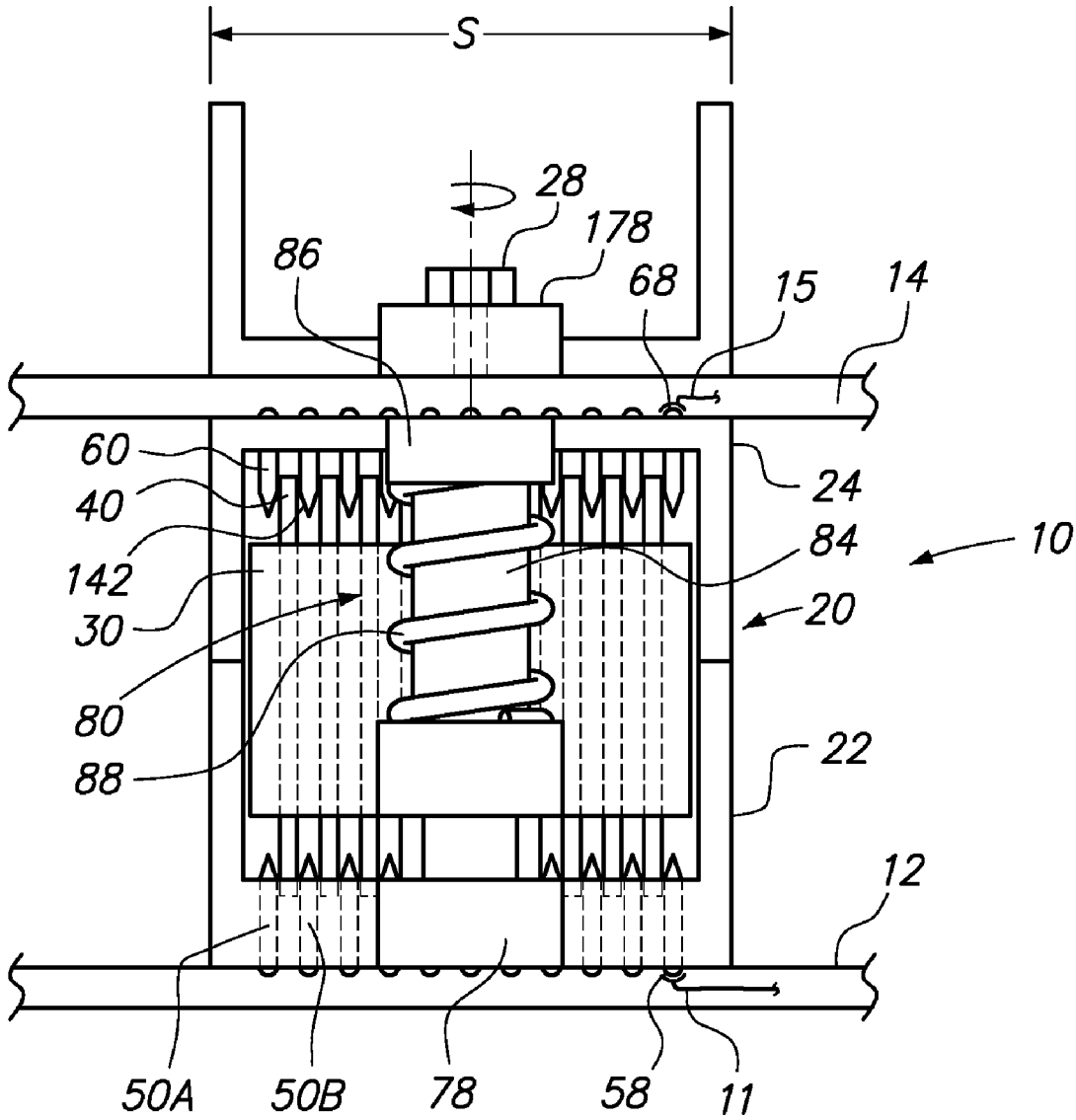
FIG. 5 is a side view of the first and second circuit boards having been electrically connected by raising the wafer carrier.

FIGS. 3-5 illustrate a sequence of connecting the first and second circuit boards 12, 14 using the connector 10. FIG. 3 is a side view of the first and second circuit boards 12, 14 being brought together for connecting with the connector 10. The second frame member 24, which is secured to the second circuit board 14 is being moved toward the first frame member 22, which is secured to the first circuit board 12. The distal end 25 of the second frame member 24 will be brought into contact and alignment with the distal end 23 of the first frame member 22. First ends of the wafers 40 extend between the upwardly-extending fins 50 on the first frame member 22. The electrically conductive ball ends 58 at the proximal ends of the fins 50 form a ball grid array (BGA) in electrical contact with circuit board contacts schematically illustrated at 11 on the first circuit board 12. A set of fins 60 are similarly secured to the second frame member 24, and the exposed second ends of the wafers 40 are aligned to be received between the fins 60 when the wafer carrier 30 is subsequently raised. The fins 60 may be similar to the fins of FIG. 2 as exemplified by the fin 50A of FIG. 2B, and include electrical contacts generally indicated at 142 (similar to the contacts 52 on the fin 50A of FIG. 2B) that terminate at electrically conductive ball ends 68. The ball ends 68 are part of a corresponding BGA that is secured in electrical contact with circuit board contacts schematically illustrated at 15 on the second circuit board 14, to electrically connect the electrical contacts 142 with the second circuit board 14.

This embodiment also optionally includes a travel limiting mechanism generally indicated at 80 for limiting the movement of the wafer carrier. The travel limiting mechanism 80 includes a shaft 82 passing through a flange 38 on the wafer carrier 30 and secured to a flange 78 of the first frame member 22. A sleeve 84 is slidably positioned on the shaft 82, and can move axially up and down on the shaft 82. A head or stop 86 is positioned on the shaft 82 to limit axial travel of the sleeve 84, and to thereby also limit movement of the wafer carrier 30 along the shaft. The coil spring 88 that biases the wafer carrier 30 to the open circuit position is optionally provided, as shown, between the flange 38 and the stop 86.

FIG. 4 is a side view of the first and second circuit boards 12, 14 having been brought together and structurally connected, prior to being electrically connected. The distal end 25 of the second frame member 24 is in physical contact and alignment with the distal end 23 of the first frame member 22. Additionally, the second frame member 24 overlaps the upper portion of the wafer carrier 30, which helps secures the rotational position of the second frame member 24 with respect to the first frame member. The threaded fastener 28 has been threadedly engaged with mating threads (not shown) on the wafer carrier 30 until the head of the threaded fastener 28 is in physical contact with the connector cap 26. The wafer carrier 30 is still in the open circuit position, with a gap "G" between the wafers 40 and the distal end of the fins 60 on the second frame member 24. Due to the gap G, the electrically conductive pathways 42 (FIG. 2A) are electrically separated from second circuit board 14 in the open circuit position. However, the electrically conductive pathways 42 are electrically connected with the first circuit board 12 due to the sliding contact between the electrically conductive pathways 42 and the sliding contacts 52 on the fins 50 (FIG. 2B). Thus, in the open circuit position of FIG. 4, the circuit boards 12, 14 are not in electronic communication via the connector 10. To place the circuit boards 12, 14 in electronic communication via the connector 10, the wafer carrier 30 is moved to the closed circuit position by further rotating the threaded fastener 28 in the direction indicated.

FIG. 5 is a side view of the first and second circuit boards 12, 14 having been electrically connected by raising the wafer carrier 30, after having been structurally connected in FIG. 4. The threaded fastener 28 has been rotated sufficiently to raise the wafer carrier 30 until the wafers 40 are positioned between the fins 60, and the electrically conductive pathways 42 of the wafers 40 have been brought into contact with the electrical contacts 152 on the fins 60. The movement of the wafer carrier 30 toward the closed circuit position of FIG. 5 acts against the biasing force provided the coil spring 88 (or by the rod-shaped spring 70 of FIG. 1B, if alternately included). Thus, the coil spring 88 gets compressed in response to this movement of the wafer carrier 30 (the rod-shaped spring 70 of FIG. 1B, if alternately included, would be laterally flexed). Upward movement of the wafer carrier 30 stops when the sleeve 84 comes to rest against the stop 86. As shown, the upper ends of the wafers 40 have been carried by the wafer carrier 30 into position between adjacent fins 60 on the second frame member 24. This overlap between the wafers 40 and the fins 60 also helps secure the rotational position of the second frame member 24 with respect to the first frame member. This overlap is not necessarily as extensive as the overlap between the wafers 40 and the fins 50, because sliding contact is not necessary between the electrically conductive pathways 42 and the contacts 152 on the fins 60. Rather, it is sufficient that the electrically conductive pathways 42 are just brought into electrical contact with the contacts 152 on the fins 60 when the wafer carrier 30 has reached the closed circuit position of FIG. 5.

In this closed circuit position, electronic communication pathways are completed that allow electronic communication between the circuit boards 12, 14. Specifically, an electronic communication pathway is established from each of the circuit board contacts 11 on the first circuit board 12 to the respective ball ends 58 on the fins 50, along the sliding contacts 52 on the fins 50 (FIG. 2B), from the sliding contacts 52 to the respective electrically conductive pathways 42 on the wafers 40 (FIG. 2A), along the electrically conductive pathways 42 to the respective electrical contacts 152 on the fins 60, to the ball ends 68 of the electrical contacts 152, and from the ball ends 68 to the respective circuit board contacts 15 on the second circuit board 14. The number of such communication pathways is determined by the number of wafers 40 selected and the number of electrically conductive pathways 42 on each wafer 40. Thus, a connector of this type could include a potentially unlimited number of communication pathways.

The above described manner of connecting the circuit boards 12, 14 using the connector 10 imparts very little stress to the circuit boards 12, 14. Positioning the distal end 25 of the second frame member 24 against the distal end 23 of the first frame member 22 (see FIG. 4) maintains the two circuit boards 12, 14 at the desired spacing while the wafer carrier 30 is moved to the closed circuit position. The forces generated by raising the wafer carrier 30 therefore reside largely in the frame 20, and these forces are not appreciably transferred to the circuit boards 12, 14. Furthermore, this manner of connecting the circuit boards 12, 14 using the connector 10 does not require forcibly pushing the two circuit boards to "snap" two connector pieces together, as would be required by many prior art connector designs. Instead, the circuit board 14 may be positioned to where the second frame member 24 is just touching (rather than forcibly engaging) the first frame member 22 before the threaded fastener 28 is threaded into the wafer carrier 30, and/or until any other desired connecting means are used to secure the second frame member 24 to the first frame member 22. Thus, any stresses that may be transferred to the circuit boards 12, 14 as a result of securing the second frame member 24 to the first frame member 22 will largely reside (if at all) along the relatively short span "S" of the circuit boards 12, 14 in the vicinity of the frame 20.

To reduce the cost of manufacture, the component used as the connector cap 26 may be substantially identical to the first frame member 22. Just as the first frame member 22 is in contact with the first circuit board 12, the connector cap 26 is in contact with the second circuit board 14. Also, just as the first frame member 22 includes a plurality of through holes 27 for receiving the ball ends 58 (see FIGS. 2B and 2C), the connector cap 26 may include a plurality of through holes for receiving the ball ends 68. However, flanges 178 on the connector cap 26 in this embodiment do not participate in the travel limiting mechanism 80.

The terms "comprising," "including," and "having," as used in the claims and specification herein, shall be considered as indicating an open group that may include other elements not specified. The terms "a," "an," and the singular forms of words shall be taken to include the plural form of the same words, such that the terms mean that one or more of something is provided. The term "one" or "single" may be used to indicate that one and only one of something is intended. Similarly, other specific integer values, such as "two," may be used when a specific number of things is intended. The terms "preferably," "preferred," "prefer," "optionally," "may," and similar terms are used to indicate that an item, condition or step being referred to is an optional (not required) feature of the invention.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A connector for connecting a first circuit board with a second circuit board, the connector comprising:

a connector frame including a first frame member secured to the first circuit board and a second frame member secured to the second circuit board, the first and second frame members removably securable to one another; and a wafer carrier movably disposed between the first and second frame members and carrying a plurality of wafers at a substantially fixed spacing, each wafer having a plurality of electrically conductive pathways on a substantially non-conductive substrate; and an actuator for moving the wafer carrier toward the second circuit board from an open circuit position in which the electrically conductive pathways are electrically connected with the first circuit board and electrically separated from the second circuit board, to a closed circuit position in which the electrically conductive pathways are electrically connected with both the first and second circuit boards.

2. The connector of claim 1, wherein the electrically conductive pathways are electrically connected with the first circuit board by a plurality of elongate electrical contacts electrically connected to the first circuit board and in sliding contact with the electrically conductive pathways on the wafers as the wafer carrier is moved between the open circuit position and the closed circuit position.

3. The connector of claim 2, further comprising:

a plurality of fins projecting from the first frame member, wherein the elongate electrical contacts are disposed on the fins.

4. The connector of claim 3, wherein the fins are spaced such that pairs of adjacent fins each receive and support one of the wafers.

5. The connector of claim 1, further comprising:

a coupling mechanism for movably securing the wafer carrier to the first frame member.

6. The connector of claim 5, wherein the coupling mechanism comprises a spring secured to the wafer carrier and the first frame member to bias the wafer carrier to the open circuit position.

7. The connector of claim 6, wherein the spring comprises a flexible rod secured to the exterior surface of the first frame member.

8. The connector of claim 5, further comprising:

a threaded member passing through the second frame member and threadedly engaged with the wafer carrier, such that rotating the threaded member advances the wafer carrier from the open circuit position to the closed circuit position.

9. The connector of claim 1, further comprising:

a shaft passing through the wafer carrier and secured to the first frame member, a sleeve slidably positioned on the shaft, and a stop along the shaft to constrain axial movement of the sleeve on the shaft, to limit travel of the wafer carrier.

10. The connector of claim 9, further comprising:

a spring disposed on the shaft between the wafer carrier and the stop to bias the wafer carrier to the open circuit position.

11. The connector of claim 1, wherein the first and second circuit boards are connected with the plane of the first circuit board parallel to the plane of the second circuit board.

12. The connector of claim 1, wherein one of the first and second circuit boards is a motherboard and the other of the first and second circuit boards is a daughter card.

13. A method of connecting a first circuit board with a second circuit board, the method comprising:

mechanically coupling a first frame member with a second frame member about a wafer carrier such that the wafer carrier is movably disposed between the first and second frame members, wherein the wafer carrier carries a plurality of wafers at a substantially fixed spacing, each wafer having a plurality of electrically conductive pathways on a substantially non-conductive substrate, and wherein the first frame member is secured to the first circuit board and the second frame member is secured to the second circuit board; and moving the wafer carrier toward the second circuit board from an open circuit position, wherein the electrically conductive pathways are electrically connected with the first circuit board and electrically separated from the second circuit board, to a closed circuit position, wherein the electrically conductive pathways are electrically connected with both the first and second circuit boards, to provide electronic communication between the first and second circuit boards when in the closed circuit position.

14. The method of claim 13, further comprising sliding the electrically conductive pathways on the wafer carrier along a corresponding plurality of elongate electrical contacts electrically connected to the first circuit board as the wafer carrier is moved between the open and closed circuit positions.

15. The method of claim 13, further comprising:

positioning a threaded member through the second frame member and threadedly engaging the threaded member with the wafer carrier to mechanically connect the first and second frame members.

16. The method of claim 15, further comprising further threadedly engaging the threaded member with the wafer carrier to advance the wafer carrier from the open circuit position to the closed circuit position.

17. The method of claim 13, further comprising biasing the wafer carrier to the open circuit position using a spring secured to the wafer carrier and the first frame member.

18. The method of claim 13, further comprising limiting travel of the wafer carrier by providing a shaft passing through the wafer carrier and secured to the first frame member, a sleeve slidably positioned on the shaft, and a stop along the shaft to constrain axial movement of the sleeve on the shaft.

19. The method of claim 18, further comprising biasing the wafer carrier to the open circuit position by providing a spring about the shaft between the wafer carrier and the stop.

20. The method of claim 13, further comprising mechanically coupling the first and second circuit boards such that the plane of the first circuit board is parallel with the plane of the second circuit board.

* * * * *